United States Patent [19]

Rowe

[11] 4,322,907

[45] Apr. 6, 1982

[54] SELF-CLOSING PROPELLANT CHARGE PACKAGE

[75] Inventor: John P. Rowe, Branford, Conn.

[73] Assignee: Olin Corporation, New Haven, Conn.

[21] Appl. No.: 126,734

[22] Filed: Mar. 3, 1980

[51] Int. Cl.[3] ..... F42B 39/00

[52] U.S. Cl. ..... 42/88

[58] Field of Search ..... 42/87, 88; 227/9; 221/64, 197, 198, 283, 307, 310; 124/45, 49, 50; 206/3

[56] References Cited

U.S. PATENT DOCUMENTS

| | | | |
|---|---|---|---|
| 391,811 | 10/1888 | Mixter | 42/87 |
| 869,484 | 10/1907 | Drake | 42/87 |
| 1,073,348 | 9/1913 | Hoagland | 42/87 |
| 2,108,902 | 2/1938 | Rasmussen | 229/7 R |
| 2,431,121 | 11/1947 | Hunter | 221/307 |
| 3,242,609 | 3/1966 | Koistinen | 42/87 |
| 3,373,520 | 3/1968 | Into | 42/87 |
| 4,020,974 | 5/1977 | Bauer et al. | 42/87 |
| 4,199,093 | 4/1980 | Combette et al. | 42/87 |

FOREIGN PATENT DOCUMENTS

| | | | |
|---|---|---|---|
| 384139 | 12/1932 | United Kingdom | 206/535 |

*Primary Examiner*—Charles T. Jordan

*Attorney, Agent, or Firm*—William W. Jones; Paul J. Lerner

[57] ABSTRACT

An improved, self-closing propellant charge package adapted for use with a gravity-operated loading device for a powder-actuated tool, comprises a tubular body having one end at least partially closed, the other end being open, and having a portion, adjacent to the open end, which is integrally formed with a plurality of deformable, charge-retaining nodes which are adapted for reformation between a first, undeformed condition, wherein passage of charges is prevented, and a second, deformed, condition admitting of ready passage of charges. The package is adapted for telescoping emplacement on a projecting tubular loading port insert on the loading device, whereby the nodes are displaced, allowing the charges to pass into the insert and, thence, into the loading device.

4 Claims, 3 Drawing Figures

SELF-CLOSING PROPELLANT CHARGE PACKAGE

BACKGROUND AND SUMMARY OF THE INVENTION

The present invention relates to a self-closing propellant charge package adapted for use with a gravity-operated loading device for a powder-actuated tool.

In order to assume the double function of packaging and loading, such a device must retain the charges when it is not mounted on the tool, and let them come out when it is mounted.

Packages assuming these functions are already known. Some of them have an end deformed, as by an elastic band, to retain propellant charges therein, the deformation being cancelled to provide for passage of the charges. Such packages are seen to suffer, however, in that it is necessary to provide slits or cut-outs in the package wall to facilitate the end deformation and also to provide and emplace the elastic band. These manufacturing steps unacceptably increase the cost of what is generally treated as a consumable or disposable item.

It is, therefore, a primary object of the present invention to provide a propellant charge package, of the type described, which may be produced at minimal cost. This is accomplished, in general, by a tubular propellant charge package having one end at least partially closed, the other end being open, and having a portion, adjacent to the open end, which is integrally formed with a plurality of deformable, charge-retaining nodes, the nodes being adapted for reformation between a first, undeformed condition, wherein passage of charges is prevented, and a second, deformed, condition admitting of ready passage of charges. More specifically, the package is adapted for telescoping emplacement on a projecting tubular loading port insert on a loading device, whereby the nodes are displaced to assume the second condition, allowing charges to pass into the loading port insert and, thence, into the loading device.

BRIEF DESCRIPTION OF THE DRAWING

The foregoing and other features of the invention may be more clearly understood by reference to the following detailed description and the accompanying drawing, therein.

DESCRIPTION OF THE PREFERRED EMBODIMENT

Figure 1:
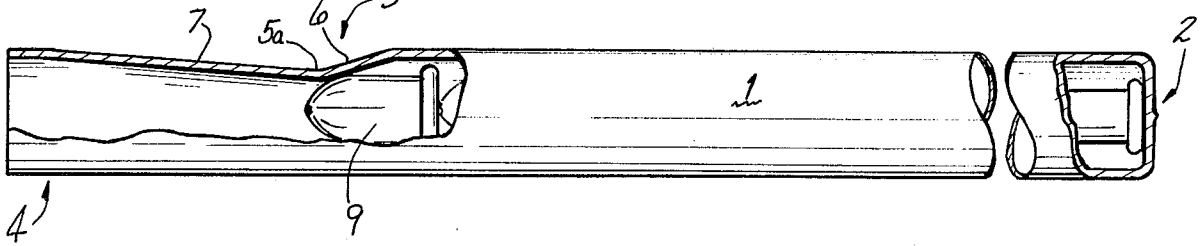
FIG. 1 is a longitudinal view, partly in cross-section, of an embodiment of the present invention.
Figure 2:
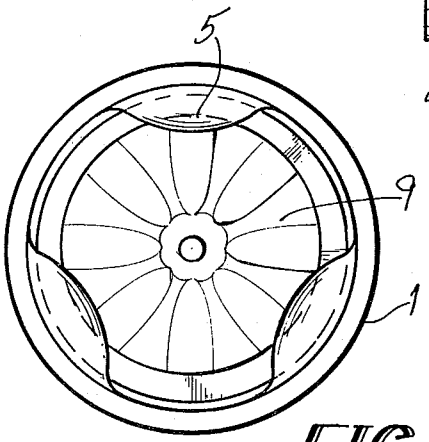
FIG. 2 is an enlarged end view of the embodiment of FIG. 1.
Figure 3:
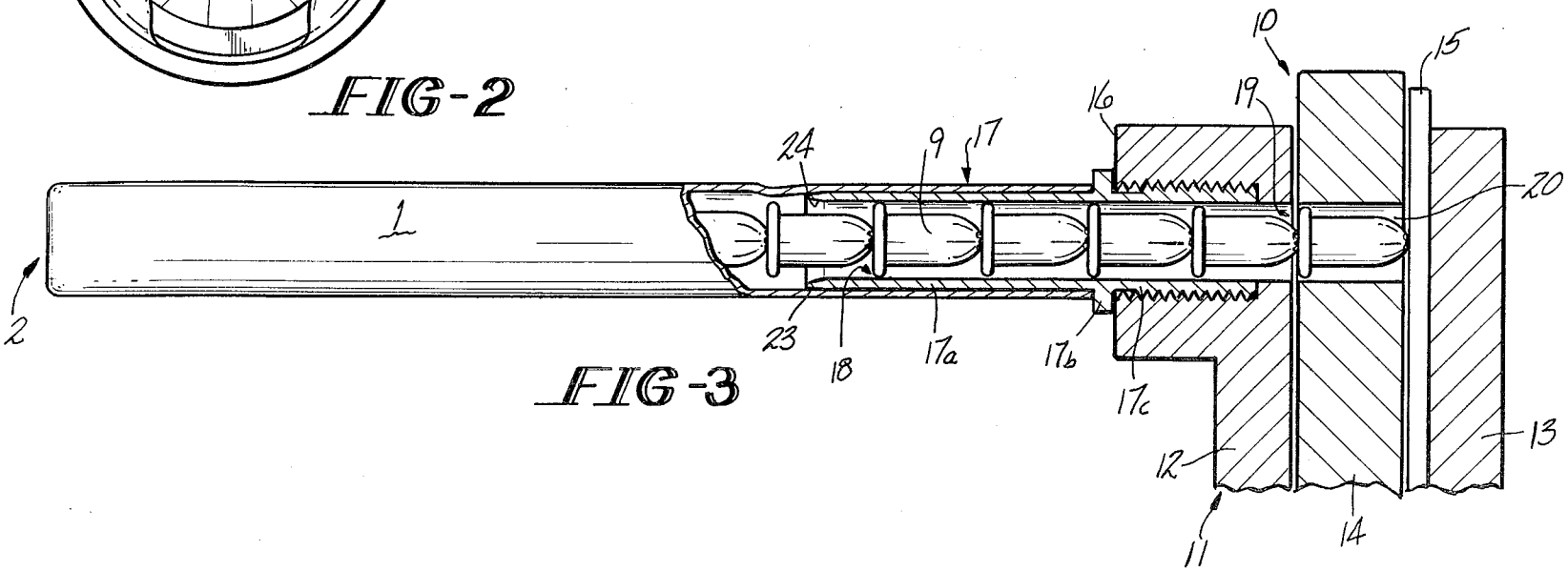
FIG. 3 is a view of the invention of FIG. 1 mounted on a powder-actuated tool.

FIGS. 1–3 show a package including a substantially tubular body 1, adapted to receive a plurality of propellant charges 9 in serial alignment, having a closed end 2 and an open end 4, through which the charges 9 are inserted and dispensed. The body 1 is formed of a resilient material, such as low density polyethylene.

In the vicinity of the open end 4, tube 1 is formed with three integral, deformable, charge-retaining nodes 5, symmetrically disposed about the periphery of the body 1 and equidistant from the open end 4. The nodes 5 are each defined by a pair of intersecting planes 6 and 7 respectively, inclined approximately 15° and 4° relative to the longitudinal axis of the body 1, and are adapted for reformation between a first, undeformed, condition, as shown in FIGS. 1 and 2, wherein passage of charges 9 through the body 1 is prevented, and a second, deformed condition, as shown in FIG. 3, admitting of ready passage of charges 9. As will be more fully explained later, the nodes 5 may be deformed, as seen in FIG. 3, by telescopic emplacement of the package on an open-ended, tubular loading port insert 17 carried by a loading device 10.

The insert 17 includes a nose portion 17*a*, adapted to be inserted into the body 1, the terminus of the nose portion 17*a* being defined by a shoulder 17*b* adapted to limit the extent of such insertion. The length of the nose portion 17*a* is slightly less than the distance between the open end 4 of the body 1 and the lines of intersection 5*a* of the pairs of planes 6 and 7. The distal end of the nose portion 17*a* may be provided with outside and inside bevels 23 and 24 respectively for facilitating the introduction of the insert 17 into the body 1 and that of the charges 9 into the insert 17.

The insert 17 is further provided with a screw thread 17*c* for attachment to the loading device 10.

The loading device 10 comprises a support 11, formed with two arms 12 and 13, the arm 12 being continued in its upper part by a sleeve 16, and a member 14 for transferring the charges into the tool combustion chamber. Member 14 is preferably pivotally mounted about a pin which is integral with support 11, for movement in a plane perpendicular to the barrel of the tool. A closure plate 15, for member 14, is pivotally mounted between member 14 and arm 13 of support 11. Sleeve 16 comprises the insert 17, the nose portion 17*a* of which projects towards the outside of sleeve 16 and bores 18, 19 and 20, each having a diameter substantially equal to the outside diameter of the charges 9, formed respectively in insert 17, sleeve 16 and transfer member 14, in such manner that the charges 9 may descend by gravity from the body 1 into the transfer member 14.

When the nose portion 17*a* of the insert 17 is being introduced into the open end 4 of the body 1, against the action of the resilient nodes 5, the later are deformed, being urged radially outwardly to positions approximating the cylindrical bulk of the body 1, whereby ready passage of the charges 9 is permitted.

The body 1, which is in abutment against the forward face of shoulder 17*b*, is maintained upon insert 17 by the constriction provided by the deformed nodes 5. The charges 9 may then be put in position in the transfer member 14 of the device 10, from the package, by gravity.

The package is thus seen to provide a holding function for the charges when it is not mounted on the loading device 10, and a release function when it is mounted on the device.

Moreover, when the package is disengaged from the device 10, the nodes 5, which are no longer held by the nose portion 17*a* of the insert 17, resiliently resume their initial position as seen in FIG. 1, holding the charges 9 within the body 1.

It will be noted that it is after an operation similar to that of mounting the package on the insert 17, that the package is initially filled with charges 9.

It is to be understood that the present invention is capable of many modifications in structure and design, within the scope of the appended claims.

I claim:

1. In the combination of a loading device for a powder-actuated tool, a projecting tubular loading port insert adapted for passage of charges therethrough and a self-closing propellant charge package, wherein said loading port insert cooperates with said loading device for the passage of charges thereinto, said charge package comprising a substantially tubular body of a size to receive a plurality of charges in serial alignment, said body having one end at least partially closed to prevent passage of charges therethrough and one end open; the improvement comprising: a plurality of deformable, charge-retaining nodes, integrally formed in a portion of said body proximate said open end, said nodes being adapted for reformation between a first, undeformed, condition, wherein passage of charges through said body portion is prevented, and a second, deformed, condition admitting of ready passage of charges through said body portion, said body being adapted for telescoping emplacement on said loading port insert whereby said nodes are displaced to assume said second condition, allowing charges in said body to pass freely through said loading port insert, into said loading device, said nodes each being defined by a pair of intersecting planes, one of said planes being inclined approximately 15° relative to the longitudinal axis of said body, the other of said planes being inclined approximately 4° relative to said axis.

2. The invention of claim 1, wherein said nodes are symmetrically disposed about the periphery of said body, equidistant from said open end.

3. The invention of claim 2, wherein there are three of said nodes formed in said body.

4. The invention of claim 1, wherein said loading port insert includes a nose portion adapted to be inserted into said body, the terminus of said nose portion being defined by a shoulder adapted to limit the extent of such insertion, the length of said nose portion being slightly less than the distance between said open end of said body and the lines of intersection of said pairs of planes.

* * * * *